US006390494B2

(12) United States Patent
Gignoux et al.

(10) Patent No.: US 6,390,494 B2
(45) Date of Patent: May 21, 2002

(54) CROSS-COUNTRY SKI BINDING

(75) Inventors: Pierre Gignoux, Coublevie; Bernard Gatel, Renage, both of (FR)

(73) Assignee: Skis Rossignol S.A, Voiron (FR)

( * ) Notice: Subject to any disclaimer, the term of this patent is extended or adjusted under 35 U.S.C. 154(b) by 0 days.

(21) Appl. No.: 09/725,305

(22) Filed: Nov. 29, 2000

(30) Foreign Application Priority Data

Dec. 6, 1999 (FR) ..... 99 15320

(51) Int. Cl.[7] ..... A63C 9/08
(52) U.S. Cl. ..... 280/615; 280/632; 280/634
(58) Field of Search ..... 280/615, 613, 280/614, 631, 632, 634; 36/117.2

(56) References Cited

U.S. PATENT DOCUMENTS

| | | | | | |
|---|---|---|---|---|---|
| 2,172,669 | A | * | 9/1939 | Taft | 280/11.35 |
| 4,273,355 | A | * | 6/1981 | Storandt | 280/614 |
| 4,836,572 | A | * | 6/1989 | Pozzobon | 280/613 |
| 4,907,817 | A | * | 3/1990 | Schwarz | 280/615 |
| 4,909,531 | A | * | 3/1990 | Graillat | 280/615 |
| 5,066,036 | A | * | 11/1991 | Broughton | 280/615 |
| 5,125,680 | A | * | 6/1992 | Bejean et al. | 280/615 |
| 5,224,730 | A | * | 7/1993 | Provence et al. | 280/615 |
| 5,282,642 | A | * | 2/1994 | Provence | 280/615 |
| 6,017,050 | A | | 1/2000 | Salomon | |
| 6,213,493 | B1 | * | 4/2001 | Korman | 280/613 |

FOREIGN PATENT DOCUMENTS

| | | | |
|---|---|---|---|
| DE | 3935202 | A1 | 5/1990 |
| DE | 19818517 | A1 | 3/1999 |
| EP | 0620711 | B1 | 4/1994 |
| EP | 0768103 | A1 | 4/1997 |
| FR | 2754726 | A | 4/1998 |

* cited by examiner

*Primary Examiner*—Brian L. Johnson
*Assistant Examiner*—Bridget Avery
(74) *Attorney, Agent, or Firm*—Bugnion S.A.; John Moetteli

(57) ABSTRACT

Cross-country ski binding for a boot equipped with two bars (61, 62), comprising a latch (2) that can be actuated by a lever (5) to hold the front bar (61) and a link rod (3) equipped with a hook (4) for catching on the rear bar (62) of the boot. The link rod (3) is urged by a tension spring (6) and is articulated to a point (26) located between the two bars of the boot, preferably on a spindle (26) secured to the latch. This construction is particularly compact and allows the boot a great deal of movement.

11 Claims, 5 Drawing Sheets

Fig.1
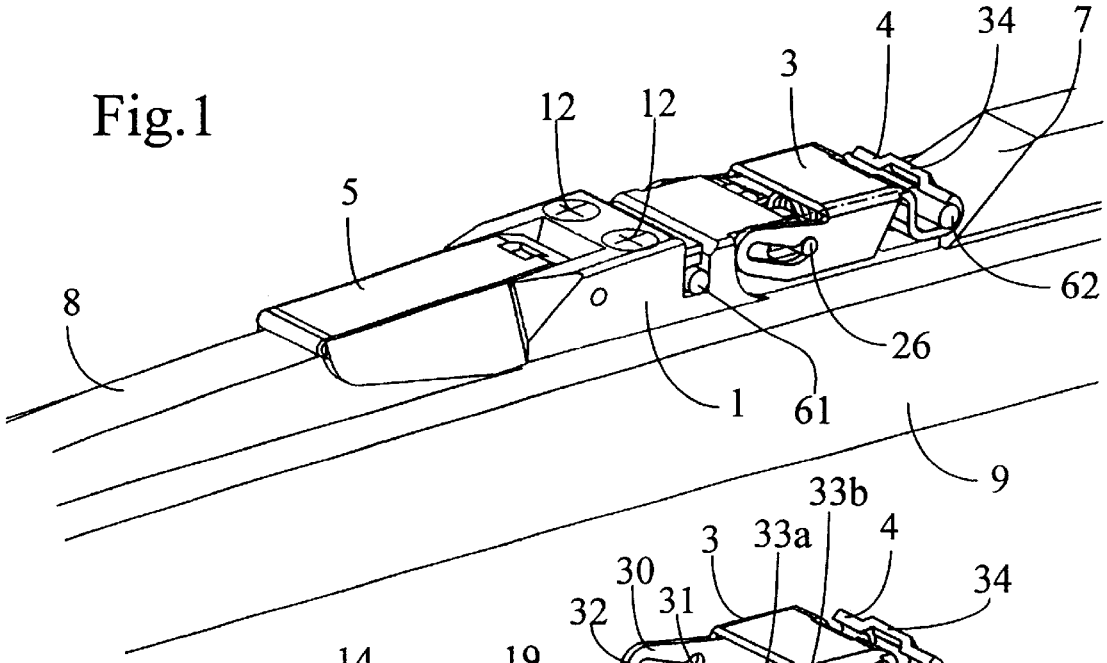
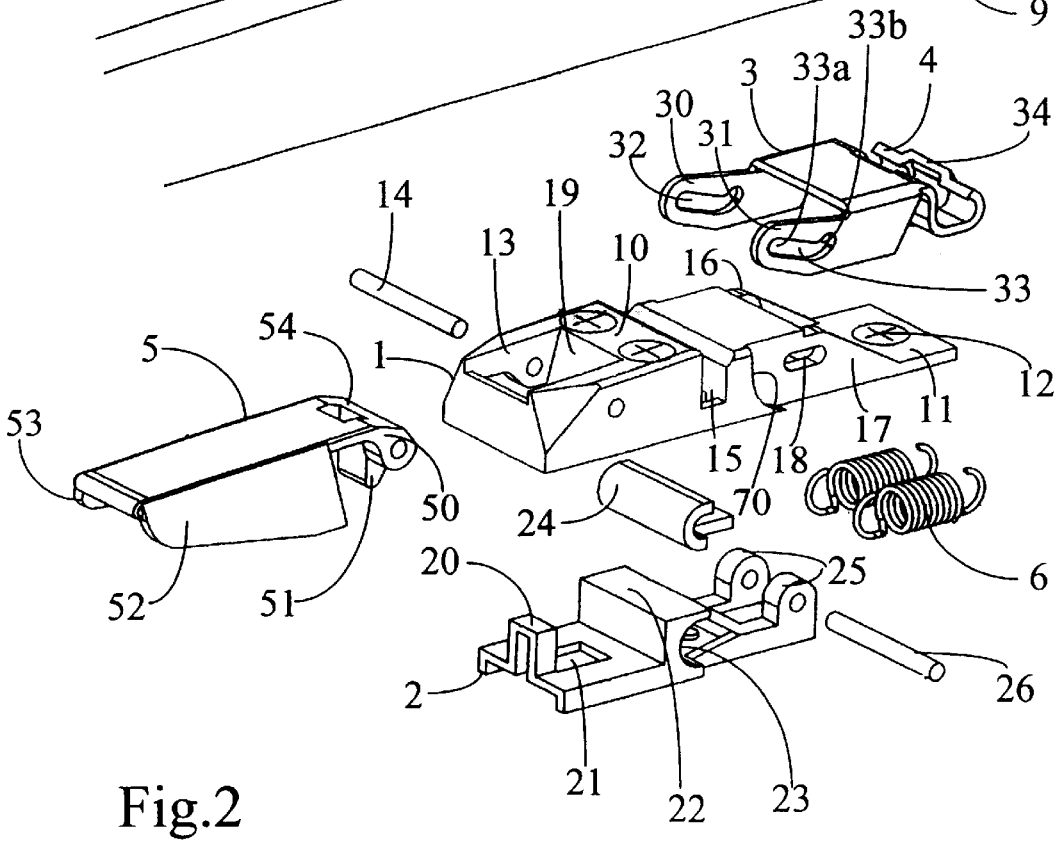
Fig.2

CROSS-COUNTRY SKI BINDING

BACKGROUND OF THE INVENTION

The subject of the present invention is a cross-country ski binding in particular a cross-country ski binding that facilitates more efficient kinematics and thus improved force transmission.

A binding such as this is known from document U.S. Pat. No. 6,017,050, the content of which is incorporated by reference. It encourages forward motion when performing the gliding step, the energy stored up in the spring exerting thrust on the ski. It also makes sure that the ski returns to against the boot when performing the skating step, during the so-called return phase when the ski is lifted from the ground and runs at an angle with respect to the general direction of travel, before being brought forward perpendicularly to the actual direction of travel.

In this binding, the link rod is articulated to the body of the binding behind its point of attachment, that is to say toward the heel of the ski, and its spring is itself attached to the body of the binding at a point located behind the articulation. The latch actuating lever, articulated in the front part of the body of the binding, actuates the latch positively both for closing and opening it and means are provided for keeping the lever in the closed position, folded down onto the ski. This construction requires a relatively long and bulky binding body. Furthermore, the maximum angle that the boot can adopt with respect to the ski as it pivots about the front bar is relatively small, of the order of 20°. This amount of movement is not sufficient for the pushing phase.

Bindings for ski touring or cross-country skiing are also known and comprise a plate equipped with means for binding the boot to the plate, this plate being articulated at the front to a base or auxiliary plate and connected to the base or respectively to the plate fixed to the ski, by a spring.

A cross-country ski boot with two binding bars is also known from patent EP 0 620 711.

SUMMARY OF THE INVENTION

A cross-country ski binding for a boot is provided, the sole of which is equipped with two parallel transverse bars located in the front part of the boot. The binding comprises a binding body on which is mounted a retainer for retaining the front bar. The retainer comprises a moving latch and a latch operating lever and a link rod articulated to the body. The link rod ends in a hook which catches on the rear bar of the boot, this rod being urged by at least one tension spring and having an engagement ramp for the rear bar. A stop keeps the link rod in a position that allows its hook to engage on the rear bar when the boot is stepping into the binding. The spring allows the boot to lift by rotation about its front bar while at the same time storing up energy which is restored in the form of elastic return returning the ski against the boot.

The binding according to the invention is one wherein the link rod is articulated at a point located forward of its hook and the spring is attached by one of its ends to the link rod and by its other end to a point located between the hook of the link rod and the front bar locking point.

A construction such as this is particularly compact. It can be housed in an interruption in the profile of a profiled ski. The position of the link rod articulation allows the boot an angular travel relative to the ski that is appreciably greater than is allowed in the binding according to the prior art, and can achieve this with a shorter link rod. Furthermore, mounting the operating lever on the body of the binding is also simplified. The front part of the body of the binding can be shortened and the operating lever can be profiled so that it can be folded down onto the profile of a profiled ski, on each side thereof.

According to one embodiment, the spring is attached to the latch. The closure of the binding is made easier because all that is required is for the lever to be pushed down partially, the spring taking on the task of completing the travel of the lever and of folding it down onto the ski, in which position the lever is held by the spring. The spring thus has three functions: pulling on the link rod, holding the latch in the closed position and holding the operating lever in the folded-down position.

According to another embodiment, the spring is attached to the body of the binding and the latch is not urged by the spring or by any other spring.

The object of the invention is to overcome the aforementioned drawbacks of the binding of the prior art.

BRIEF DESCRIPTION OF THE DRAWINGS

The appended drawing depicts, by way of example, one embodiment of the invention.

FIG. 1 is a perspective view of the closed binding mounted on a ski.

FIG. 2 is an exploded view thereof.

DESCRIPTION OF THE PREFERRED EMBODIMENT(S)

Figure 3:
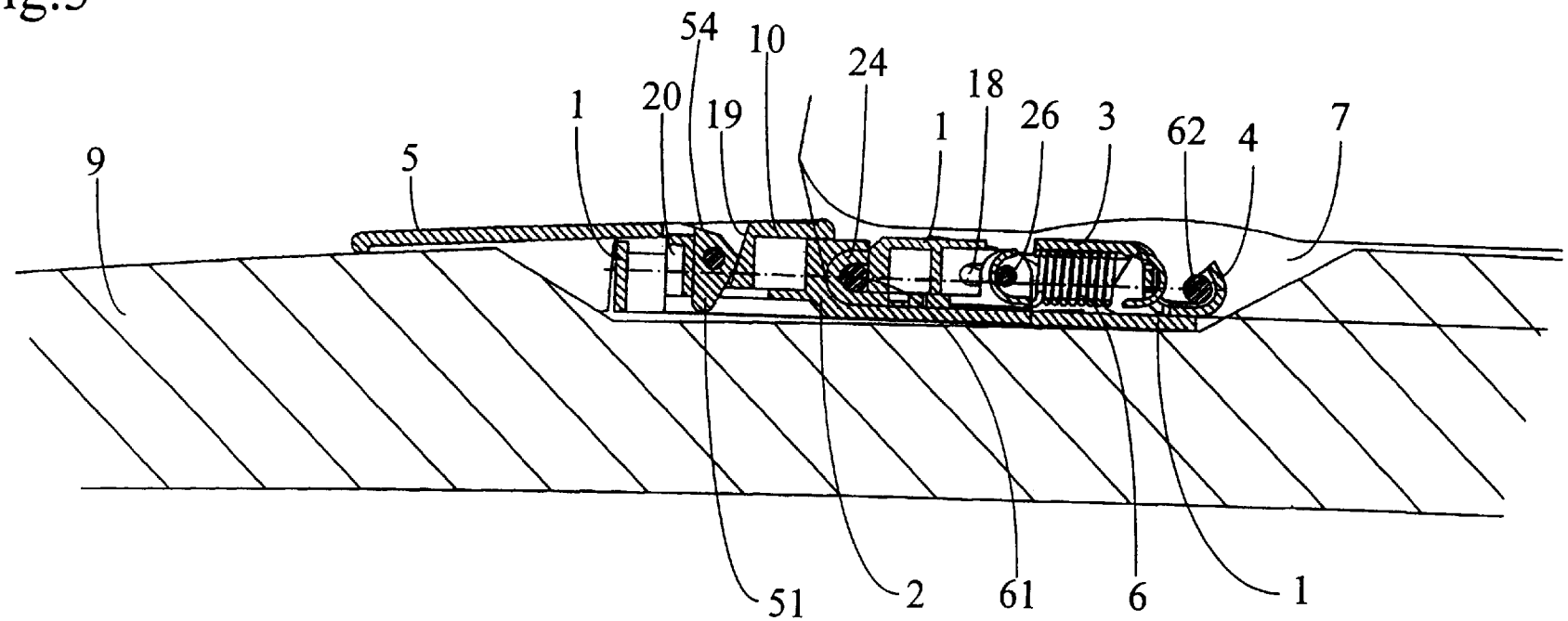
FIG. 3 is a view in axial section on a vertical plane of the binding in the closed position.

The binding is made up of a body 1 intended to be fixed to the ski, of a latch 2 mounted to slide in the body 1, of a link rod 3 ending in a hook 4, of an opening lever 5 and of a pair of springs 6 connecting the latch 2 to the link rod 3. In this instance, the binding is mounted in an interruption 7 of a rib 8 of a cross-country ski 9.

The binding body 1 has two parts 10 and 11 bearing against the ski via which parts the body is fixed to the ski by means of three screws 12. In its central part, the body 1 forms a bridge under which the latch 2 passes, which latch can slide longitudinally under this bridge. At the front, the body 1 has a rectangular recess 13 forming two side walls between which the lever 5 is articulated about a spindle 14. In its central part, the body 1 also has a rectangular transverse groove 15 intended to house the front bar of the boot as will be explained later on. Behind the groove 15, the body 1 has two vertical side walls 16 and 17 in each of which there is formed a slot 18 running parallel to the plane of the binding.

At the front, the latch 2 has a vertically raised central part 20, behind which there is a rectangular cutout 21 running along the axis of symmetry of the latch. Behind this cutout 21, the latch 2 has an elevation 22 of rectangular overall shape, in the back of which an essentially semicircular channel 23 is formed. Housed in this channel is an insert 24 which has a semi-cylindrical C-shaped profile which exactly fits into the channel 23. The latch is made of plastic and the insert is made of metal. Behind the insert 24, the latch 2 has a pair of parallel arms 25 carrying a transverse bar 26.

The link rod 3 is a metal component which is stamped and bent in such a way as to exhibit two arms 30 and 31 in the form of two parallel wings directed toward the front and the hook 4. The wings 30 and 31 have a slot 32 and 33 respectively, in which slots the ends of the bar 26 are engaged, which bar also passes through the slots 18 in the body 1. The springs 6 are attached, on the one hand, to the bar 26, and on the other hand to the link rod 3, more precisely into the front wall of the hook 4 through which the ends of these springs pass via two holes which are visible in FIGS. 3 and 5.

The lever 5 has a part 50 through which the spindle 14 passes and which has a part in the shape of a cam 51 engaged in the body 1, between the front projection 20 of the latch 2 and the slightly backwardly inclined transverse wall 19 of the body 13, which wall bounds the hollow 13 at the back.

The slots 32 and 33 in the link rod 3 have a relatively long section such as 33*a,* which is slightly oblique and slopes upward toward the front of the binding and a short section such as 33*b* which is oblique and slopes upward toward the rear, so that the slots have the shape of a boomerang, the rear arm of which is truncated.

The way in which the binding works will now be described by means of FIGS. 3 to 6. The starting point will be the open position depicted in FIGS. 4 and 5.

Figures 4, 5:
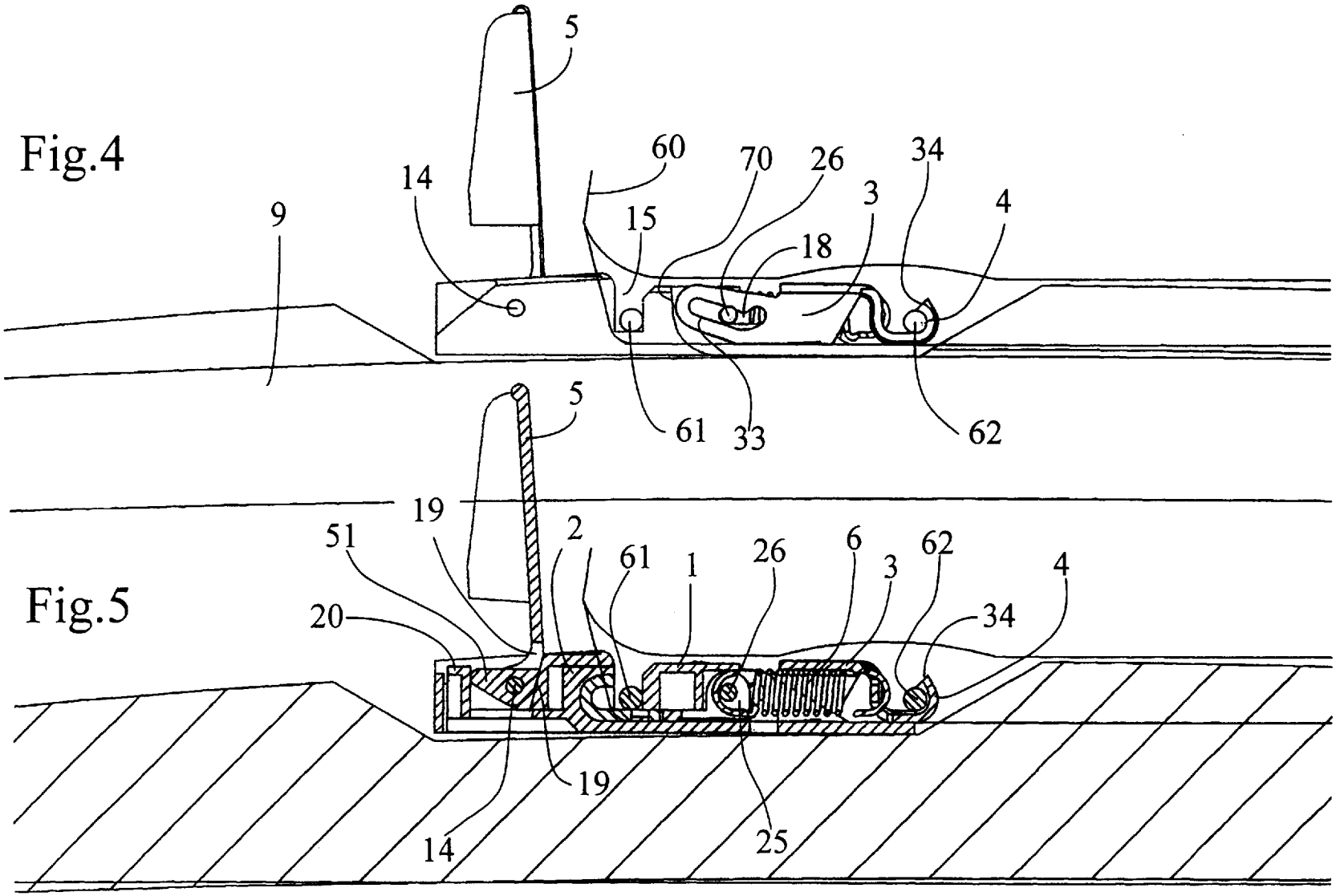
FIG. 4 is a side view of the binding, open.
FIG. 5 is a view in vertical axial section of the binding in the open position.

In the open position, the lever 5 is up and its cam 51 has pushed the latch 2 forward via its part 20. The lever 5 has come into abutment against the inclined face 19 via a flat 54 and is kept in this position by the thrust of the latch on the end of the cam 51, the direction of which thrust passes over the spindle 14 and therefore exerts a torque which tends to cause the lever 5 to turn in the opening direction. The link rod 3 is in abutment against stops 70 formed in the flanks of the body 1 (FIGS. 1 and 4). In this stable open position, a boot equipped with two parallel bars 61, 62 in the front part of its sole can be introduced into the binding. In the customary way, the foot is slightly inclined forward when stepping into the binding. The front bar 61 thus engages in the groove 15, the upper edges of which are chamfered to make this engagement easier. The boot thus positioned can be pushed down so that its rear bar 62 butts against the inclined plane 34 formed at the end of the hook 4, so that the bar 62 can push the hook 4, and with it the link rod 3, back against the action of the springs 6. As the latch 2 moves forward, the spindle 26 is shifted forward in the slots 18 and in the slots 32 and 33.

The lever can then be folded down onto the ski, releasing the latch 2, which is pulled back by the springs 6 until its part 22 with the insert 24 comes into abutment against the rear face of the groove 15, surrounding the front bar 61 of the boot, as depicted in FIGS. 1 and 3.

Figure 6:
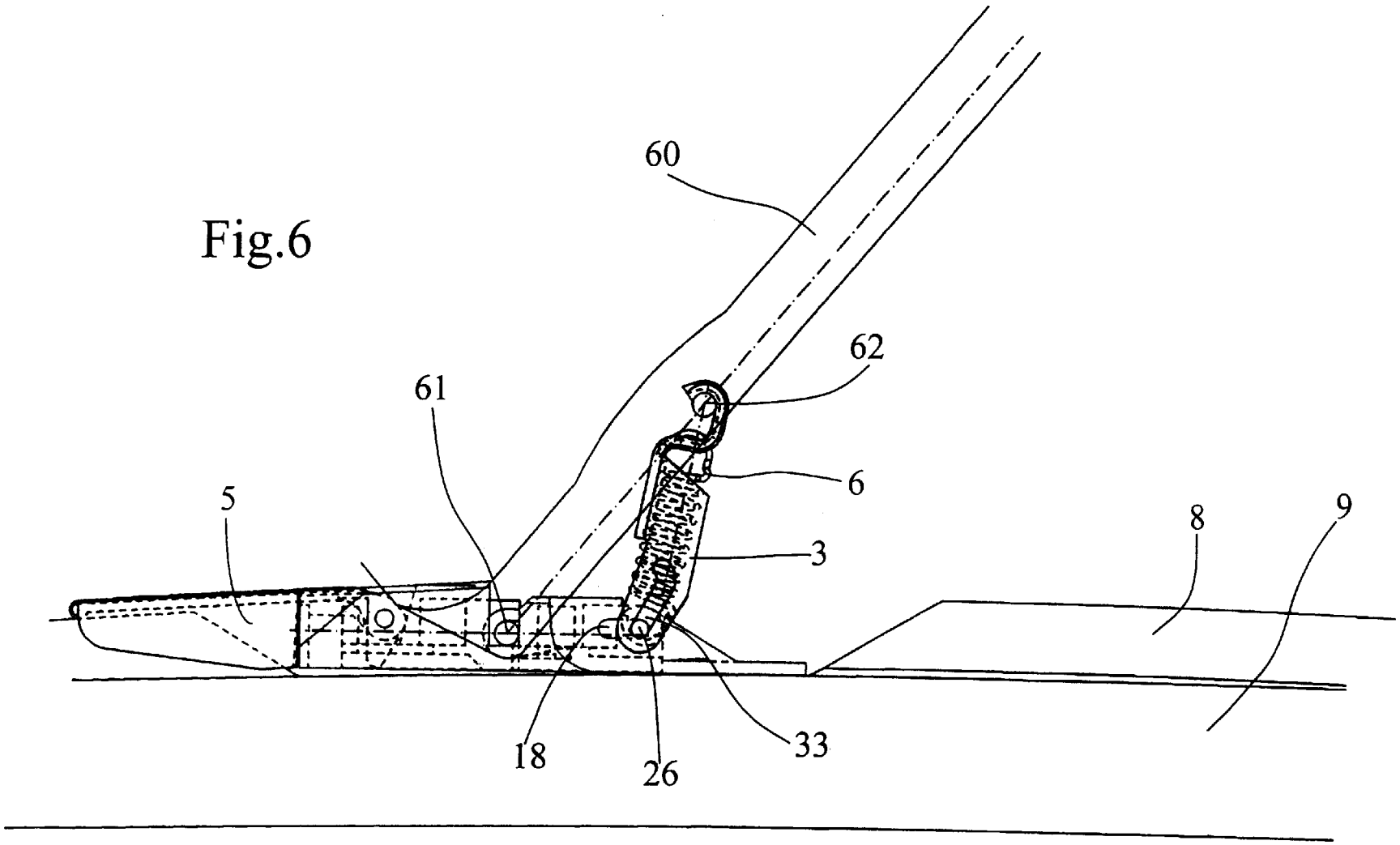
FIG. 6 depicts the binding when the boot is in a raised position relative to the ski.

In motion, whether this be in classical steps or in skating steps, when the boot 60 moves away from the ski, pivoting about its front bar 61 as depicted in FIG. 6, the link rod 3 is driven by the rear bar 62 of the boot, exerting tension on the springs 6. The maximum travel of the link rod 3 is limited by the bar 26 when it reaches the front end of the slots 32 and 33. Thus, the extension of the springs 6 is also limited. It can be seen that the movement of the link rod 3 and thus the elongation of the springs 6 is relatively small for a lifting of the boot through 50° relative to the ski, which allows for optimum stride length both when using the classic step and when using the skating step. As the elongation of the springs is relatively small, these can be strong so as to provide good ski return and forward thrust when using the classical step.

The short length of the binding and the shape of the lever 5 are to be noted. The compact nature of the binding allows it to be housed in a relatively short interruption 7 in the rib 8 of the ski. The lever 5, with its oblique and divergent lateral wings 52, 53 mimics the trapezoidal profile of the rib 8 of the ski.

The components of the binding may, of course, have shapes that differ from those depicted. For example, the link rod could be a solid part engaged between the springs 6 and articulated to the bar 26 by a single slot.

The binding depicted could easily be modified to also allow automatic locking of the front bar 61. All that would be required would be the provision of an inclined plane on the latch 2 so that the bar 61 could move the latch away in the same way as the bar 62 moves the hook 4 away, and for its wall 19 to be dispensed with so as to allow the latch to move forward, the lever 5 being folded down.

Figure 7:
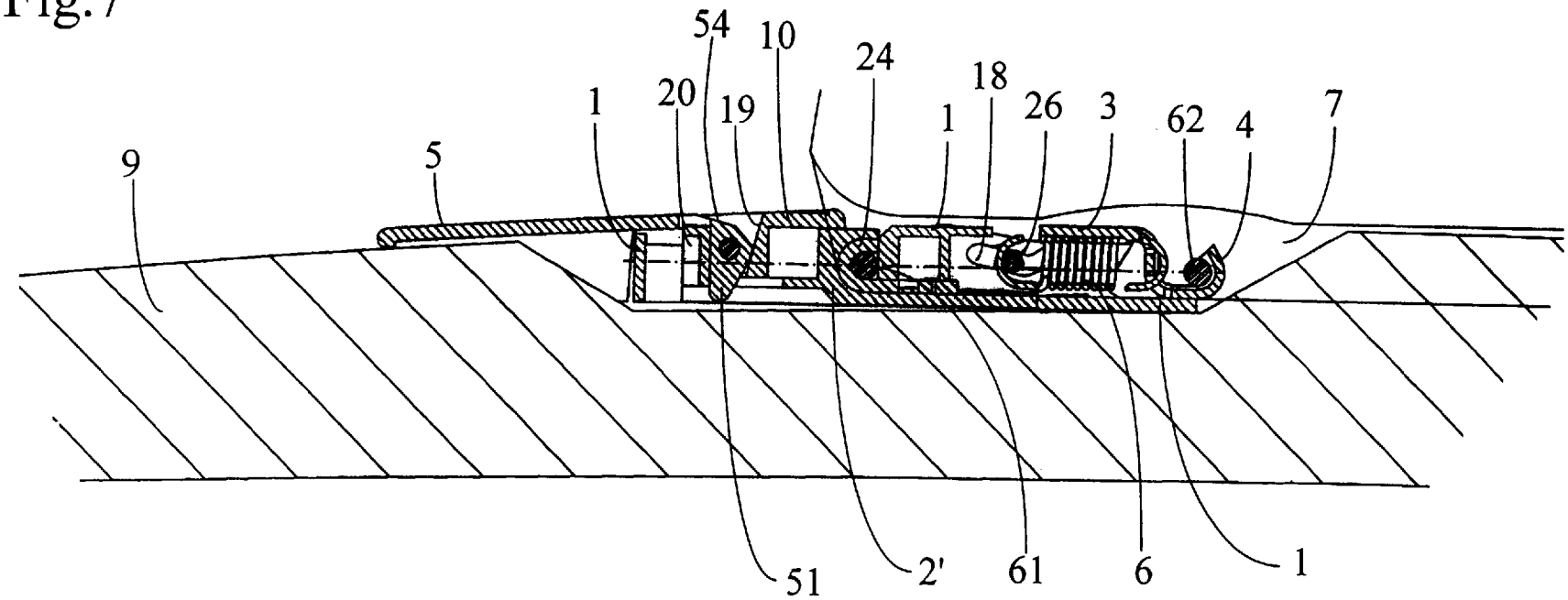
FIG. 7 is a view similar to that of FIG. 3, of an alternative embodiment.

FIG. 7 depicts an alternative form of the embodiment in which the bar 26 is fixed to the body 1. The spring 6 is therefore not connected to the latch 2' which differs from the latch 2 only in the omission of the part intended to carry the bar 26. The movement of the latch 2' is brought about entirely by the lever 5, via its cam-shaped part.

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed:

1. A cross-country ski binding for a boot, the sole of which is equipped with two parallel transverse bars (61, 62) located in the front part of the boot, the ski binding comprising a binding body (1) on which are mounted means for retaining a front bar comprising a moving latch (2) and a latch operating lever (5), a link rod (3) articulated to the body and ending in a hook (4) which catches on a rear bar (62) of the boot, the link rod being urged by at least one tension spring (6) and having an engagement ramp (34) for the rear bar, a stop (70) keeping the link rod in a position that allows its hook to engage on the rear bar when the boot steps into the binding, the spring (6) allowing the boot to lift by rotation about its front bar while at the same time storing up energy which is restored in the form of elastic return returning the ski against the boot, wherein the link rod (3) is articulated at a point located forward of its hook and the spring (6) is attached by one of its ends to the link rod (3) and by its other end to a point located between the hook (4) of the link rod and a front bar locking point.

2. The binding as claimed in claim 1, wherein the spring (6) is attached to the latch (2).

3. The binding as claimed in claim 2, wherein the latch (2) carries a bar (26) to which the spring (6) is attached and the link rod (3) is articulated to the bar with play allowing it to move in translation as the boot is lifted relative to the ski binding.

4. The binding as claimed in claim 3, wherein the link rod (3) is articulated to the latch bar (26) via at least one slot (32, 33) allowing the link rod to move in translation.

5. The binding as claimed in claim 4, wherein the slot (32, 33) has, from the front backward, a first downward oblique section (33*a*) and a second upward oblique section (33*b*), the first section being appreciably longer than the second section, the position of the slot being such that when the binding is in a closed position, the bar (26) is at the rear end of the slot.

6. The binding as claimed in claim 1, wherein the operating lever (5) has a cam-shaped part (51) for pushing the latch forward.

7. The binding as claimed in claim 2, wherein the operating lever (5) has a cam-shaped part (51) for pushing the latch forward.

8. The binding as claimed in claim 3, wherein the operating lever (5) has a cam-shaped part (51) for pushing the latch forward.

9. The binding as claimed in claim 4, wherein the operating lever (5) has a cam-shaped part (51) for pushing the latch forward.

10. The binding as claimed in claim 5, wherein the operating lever (5) has a cam-shaped part (51) for pushing the latch forward.

11. The binding as claimed in claim 1, wherein the spring (6) is attached to the body (1) of the binding and the lever (5) is shaped in such a way as to push the latch (2') into a locked position.

* * * * *